US005222823A

United States Patent [19]

Conforti

[11] Patent Number: 5,222,823

[45] Date of Patent: Jun. 29, 1993

[54] DEVICE FOR MARKING TICKETS FOR GAME OF CHANCE WITH TRANSLUCENT, VIBRANT COLORED INK

[76] Inventor: Patricia A. Conforti, 4217 Ironwood Ave., Seal Beach, Calif. 90740

[21] Appl. No.: 851,344

[22] Filed: Apr. 14, 1986

[51] Int. Cl.[5] ..... B43K 5/00

[52] U.S. Cl. ..... 401/202; 401/196; 401/198; 106/20 R; 106/22 B; 106/23 B; 260/DIG. 38; 525/54.4

[58] Field of Search ..... 401/198, 202, 196; 106/22, 23, 20; 260/DIG. 38; 525/54.4

[56] References Cited

U.S. PATENT DOCUMENTS

| | | | |
|---|---|---|---|
| 173,064 | 2/1876 | Rose | 401/202 |
| 3,244,558 | 4/1966 | Chang | 117/38 |
| 3,436,163 | 4/1969 | Calabrese et al. | 401/202 |
| 4,186,020 | 1/1980 | Wachtel | 106/22 |

OTHER PUBLICATIONS

Chemical Abstract, Kato, vol. 85, 1976, #126017j, Japanese Kokai 76 77,436.

Chemical Abstract, Akamatsu et al., vol. 76, 1972, #114942h, German Patent No. 2,130,936.

Chemical Abstract, Grau et al., vol. 82, 1975, #157831n, Canadian Patent No. 954,291.

Chemical Abstract, vol. 81, (1974), No. 39079e.

*Primary Examiner*—Amelia Burgess Yarbrough

*Attorney, Agent, or Firm*—Dowell & Dowell

[57] ABSTRACT

A marking device for marking numbers on tickets of games of chance, such as "throw-away" bingo tickets, includes a container having a mouth and a porous applicator body mounted into the mouth. An aqueous, translucent, vibrant colored, substantially freely flowing liquid ink composition is contained in the container, and is applied to the game-of-chance tickets through the porous applicator body. The ink contains, in the aqueous medium, a dyed melamine copolymer resin which is known and available in the trade under the DAYGLO mark. The dyed melamine copolymer pigment provides the unusually bright color to the ink composition of the invention.

10 Claims, 2 Drawing Sheets

DEVICE FOR MARKING TICKETS FOR GAME OF CHANCE WITH TRANSLUCENT, VIBRANT COLORED INK

BACKGROUND OF THE INVENTION

1. Field of the Invention

The present invention is directed to marking devices. More particularly, the present invention is directed to a marking device ideally suited for marking disposable tickets for games of chance with a translucent, vibrant colored ink. The present invention is also directed to the ink composition contained in the marking device.

2. Brief Description of the Prior Art

Ink compositions and marking devices are well known in the prior art. One well-known marking device of the prior art is known throughout the United States under the HI-LITER trademark of Dennison Manufacturing Company of Framingham, Mass., and comprises a felt tip pen, which leaves a translucent, bright yellow mark on paper. The term "translucent" in this respect means that the mark does not obscure or cover the printed symbol on the paper to which the mark is applied.

In connection with the marking of numbers on tickets of games of chance, such as the so-called "throw-away" bingo tickets, the prior art generally uses a liquid ink composition contained in a container equipped with a sponge rubber or like applicator. When not in use, the container is capped with a removable thread-on cap. The desired number (or numbers) on the ticket for the game of chance (as, for example, on the "throw-away" bingo tickets) is marked by simply touching, gently rubbing, or rolling the sponge rubber applicator on the number or numbers.

Ink compositions of the prior art leave a colored spot on the "marked" number. In this respect, the ink spots of the prior art serve, by-and-large, adequately to distinguish the desired number from the rest of the numbers on the ticket. However, the mark obtained in the above-described manner and in accordance with the prior art, is usually rather bland looking.

With regard to the foregoing, it should be understood that, in order to enhance the pleasure derived from playing games of chance, particularly the popular bingo game, the marking of numbers on the tickets should preferably be effortless. The marks should be conspicuously visible, even to old people and to people with somewhat impaired vision. The ink spot deposited by marking, of course, must not obscure the underlying number, and must dry readily to avoid inconvenience to the players. Still further, and perhaps most importantly, aesthetic considerations come into play. The marks should, of course, be pleasant to look at. Therefore, there is a definite need in the prior art for an applicator device and an ink composition which is easy to apply to so-called "throw-away" tickets for games of chance, particularly to "throw-away" bingo tickets, which dries sufficiently rapidly and which provides a pleasing conspicuous, bright vibrant color spot to mark a number selected by a player. The present invention provides such an applicator device and ink composition.

SUMMARY OF THE INVENTION

It is an object of the present invention to provide an applicator device and ink composition for the marking of pre-existing printed symbols on paper, particularly on tickets for games of chance.

It is another object of the present invention to provide an applicator device and ink composition which satisfies the foregoing objective, and which is easy to apply to "throw-away" tickets, and which leaves a bright, vibrant colored, translucent spot to mark on the ticket one or more numbers selected by a player.

The foregoing and other objects and advantages are attained by a marking device which includes a container having a mouth, and a porous applicator body mounted into the mouth of the container. An aqueous, translucent, vibrant colored, substantially freely flowing liquid ink composition is contained in the container, and can be dispensed from the container through the porous applicator body. When not in use, the container is sealed by a thread-on or like cap. The ink composition in the container includes in the aqueous medium a vibrant, fluorescent-type, bright pigment comprising a dyed melamine copolymer resin. The dyed melamine copolymer resin ingredient of the ink is preferably obtained as an aqueous slurry composition known in the industry under the DAYGLO mark of Dayglo Color Corporation of Cleveland, Ohio. The ink composition of the invention further includes a preservative agent, a defoaming agent, and a stabilizing agent.

The features of the present invention can be best understood, together with further objects and advantages, by reference to the following description, taken in connection with the accompanying drawings.

DESCRIPTION OF THE PREFERRED EMBODIMENT

The following specification, taken in conjunction with the drawings, sets forth the preferred embodiment of the present invention. The embodiment of the invention disclosed herein is the best mode contemplated by the inventor for carrying out her invention, although it should be understood that several modifications can be accomplished within the scope of the present invention.

Figure 1:
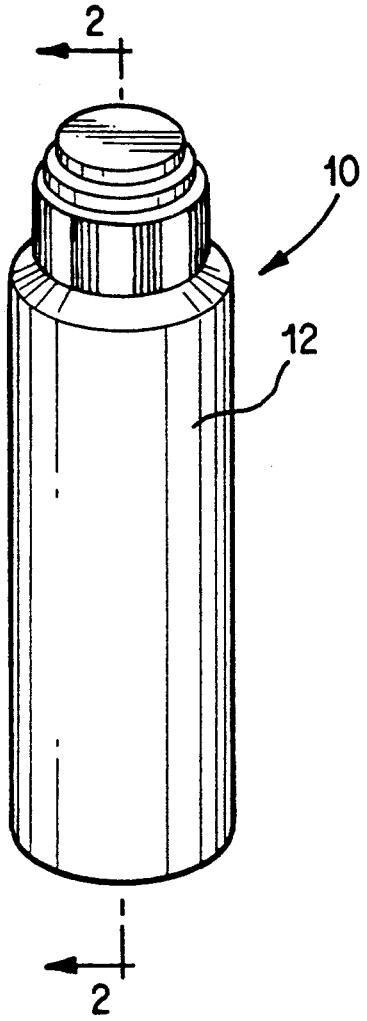
FIG. 1 is a perspective view of the applicator device and ink composition combination of the present invention.
Figure 2:
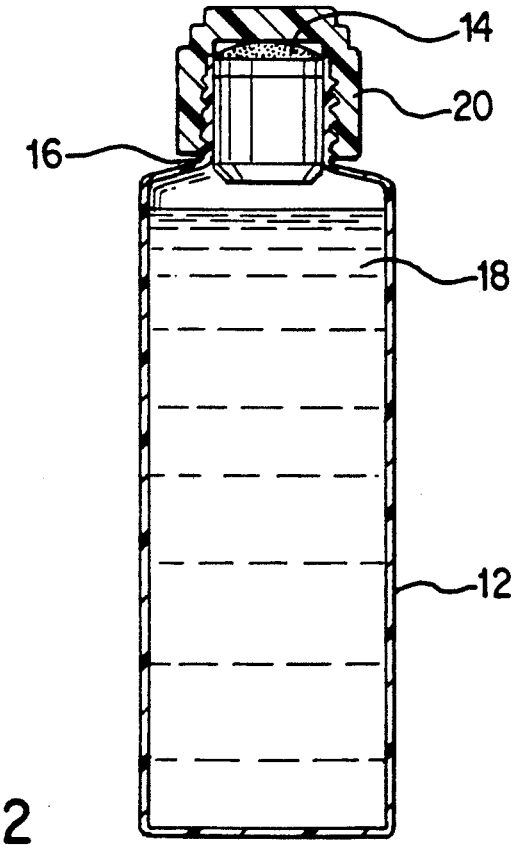
FIG. 2 is a cross-sectional view taken on lines 2,2 of FIG. 1.
Figure 3:
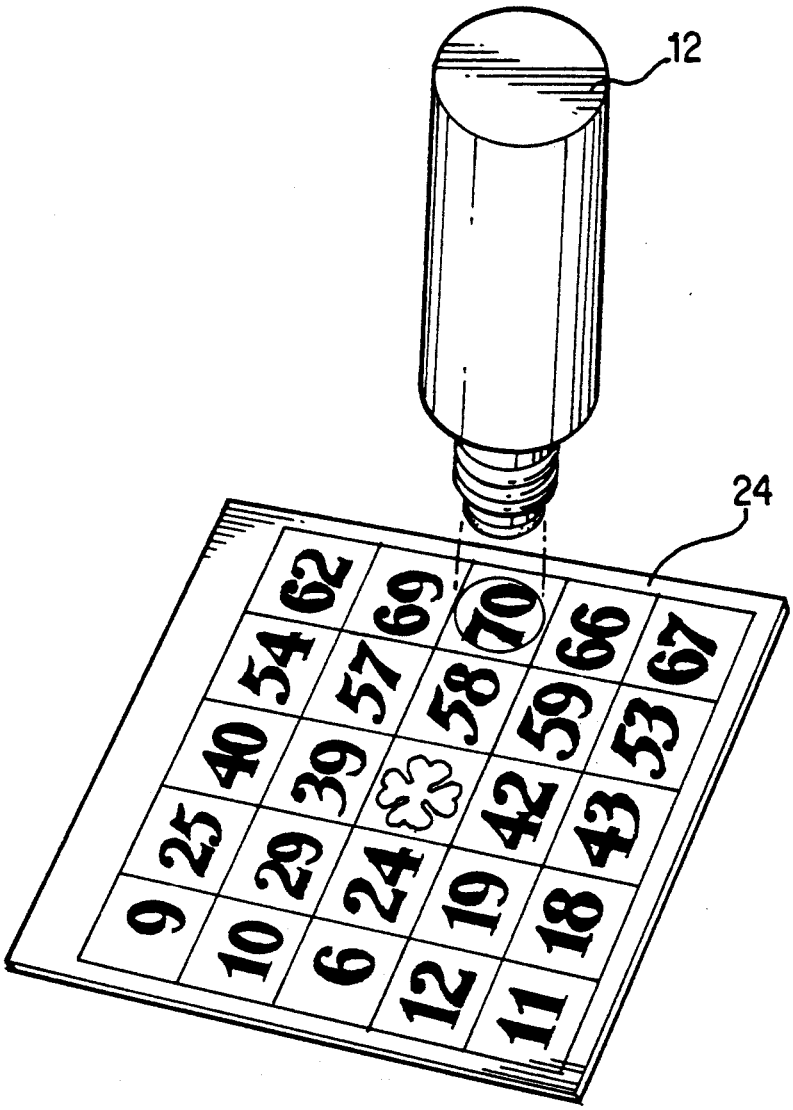
FIG. 3 is a view schematically showing the application of the ink composition of the present invention to a "throw-away" bingo ticket.

Referring now to the drawing Figures, the novel combination of the marking or applicator device and ink composition of the present invention is disclosed as follows. The applicator device 10 includes a bottle or container 12. A sponge rubber 14 or like member is mounted into the mouth 16 of the container 12. The sponge rubber member 14, of course, prevents fast spillage of liquid from the container 12. The main function of the sponge rubber member 14, however, is to act as an applicator for applying the liquid ink composition 18 of the invention to paper, as is shown schematically on FIG. 3. The applicator device 10 includes a thread-on, or like, removable cap 20, which is preferably kept tightly closed when the applicator device 10 is being shipped or stored. The container 12, together with the sponge rubber member 14 and the thread-on cap 20, per se, are not new, and therefore need not be described here in further detail.

The liquid ink composition 18, on the other hand, is novel, and cooperates with the container 12, and particularly with the sponge rubber member 14, to provide the novel results of the present invention. In this connection, it is noted that the ink of the present invention has a unique application, namely the marking of the pre-printed numbers on tickets of a game of chance (such as bingo tickets), through the sponge rubber 14 with relatively large spots. Therefore, the ink composition must meet several requirements.

More specifically, the ink composition 18 must be sufficiently free flowing so as to be able to penetrate and pass through the sponge rubber 14 to deposit just the right amount of liquid ink on paper. The ink composition 18 must not flow through the sponge rubber 14 too fast, so as to flood the paper, nor must it permit liquid to drop when the marking device 10 is turned upside down without touching paper.

Furthermore, the ink composition 18 of the invention must have the right power of penetration into paper. In other words, when the sponge rubber member 14, which is soaked with the ink 18, touches paper, the deposited ink must penetrate into the pores of the paper rather than leaving a pool or layer of ink on the paper surface Still further, the ink 18 of the invention must dry at the proper rate. On the one hand, the ink 18 must not "dry out" in the sponge applicator 14. On the other hand, it must dry sufficiently fast in the paper so as not to create a wet nuisance spot on the marked-up ticket.

Perhaps most importantly from the standpoint of the present invention, the ink composition 18 must provide a vibrant, intense color on the paper, even though the deposited ink must not obscure or cover the pre-printed symbol or number on the paper.

A specific composition which, in accordance with the present invention, meets the foregoing and other requirements, and which can be considered as the preferred embodiment of the ink 18 of the present invention, has the following ingredients in the following specific proportions:

| Ingredients | Proportions |
|---|---|
| Water | Approximately 70% by Weight |
| Preservative | Approximately 0.1% by Weight |
| Defoamer | Approximately 0.3% by Weight |
| Ethylene Glycol | Approximately 3.5% by Weight |
| Stabilizer | Approximately 0.4% by Weight |
| Clay | Approximately 3% by Weight |
| Color (Pigment) | Approximately 23.5% by Weight |

The preservative specifically used in the above-described specific embodiment is dimethyloxy solidine, available from Cosan Chemical Corporation of Carlstadt, N.J. under the COSAN 101 designation or mark. The function of the preservative is to prevent bacterial growth in the ink composition 18, but the precise chemical nature of the preservative is not critical. Other preservatives, such as phenylmercuric acetate and ortho-phenylphenate, may also be used. The proportion or amount of the preservative in the composition is important only to the extent that a sufficient amount should be present to substantially prevent bacterial growth.

The defoaming agent specifically used in the above-disclosed composition is available from Colloid, Inc. of Richmond, Calif., under the BUBBLE BREAKER 677D mark or designation. It is a silicon-containing defoaming agent, the function of which is to substantially prevent formation of foam and bubbles when the ink composition 18 is applied to a bingo ticket 24, as is schematically shown on FIG. 3 of the appended drawings. The defoaming agent also prevents excessive bubble or foam formation in the container 12 when the container 12 is shaken. Defoamers, other than the above-mentioned specific composition, can also be used in accordance with the present invention.

The purpose of the ethylene glycol in the preferred composition of the present invention is to act as an antifreezing agent. Instead of ethylene glycol, other antifreeze agents, and polyols, such as diethylene glycol, triethylene glycol, or hexylene glycol can also be used. The upper limit of the proportion or amount of the ethylene glycol (or other polyol) ingredient in the composition of the invention is dictated by the fact that the presence of polyols prolongs the drying time of the composition 18. Thus, if the proportion of polyols were too large, the ink 18 would not dry sufficiently fast. In addition to polyols, other antifreeze agents, even alcohols such as methyl or ethyl alcohol, can be used in the composition of the invention. The presence of volatile alcohols (or other volatile and flammable components) in the ink composition 18 of the present invention is not usually considered advantageous, however, because of the potential fire hazard.

The stabilizer specifically used in the herein-disclosed specific embodiment of the ink composition 18 of the present invention is carboxymethylcellulose. Fibrous carboxymethylcellulose is known and available in the trade, for example, under the METHOCELL mark. The carboxymethylcellulose fibers form a protective colloid with the finely dispersed pigments or coloring agent described below.

The stabilizing agent plays a very important role in the composition 18 of the present invention in that, without the stabilizing agent, the pigments or coloring agent would settle out too rapidly from the ink composition 18. The use of insufficient stabilizer causes settling of the pigments, whereas too much stabilizer renders the composition tixotropic, and unable to sufficiently penetrate the sponge rubber applicator member 14. The upper limit of METHOCELL brand carboxymethylcellulose, which may be used in the composition of the present invention, is approximately 0.7 percent, by weight.

Instead of carboxymethylcellulose, other stabilizing agents, such as various clays and aluminum silicate, could also be used in the composition of the present invention. In this regard, the clay co-acts with the carboxymethylcellulose as a co-stabilizing agent or thickener in the composition. It should be kept in mind that, whereas carboxymethylcellulose and clay can each serve as a substitute for the other in the composition, best results are obtained when the two are employed jointly in the above-noted proportions. The clay used in the herein-described preferred embodiment is Georgia clay with approximately 325 mesh particle size designation. The upper limit of clay to be used in the composition of the present invention is approximately 5 percent, by weight.

The color or pigment used in the composition of the present invention is probably its most important ingredient in that a principal stated objective of the invention is to provide a vibrant, bright color, which visually distinguishes the ink composition 18 from the ink compositions of the prior art. The pigment or color used in the herein-described specific embodiment is a dyed melamine copolymer resin available from Dayglo Color Corporation of Cleveland, Ohio under the DAYGLO mark or designation. The above-noted DAYGLO pigment is actually well known in the trade, and is known to be available in the form of an aqueous slurry, which contains approximately 50 percent, by weight, of solid material. Because of the vibrant, vivid colors that the DAYGLO pigments provide, the product is known as a "fluorescent" paint, although the pigment is not necessarily fluorescent in the scientific sense of the term.

The above-noted dyed melamine copolymer resin pigment, or better stated, the commercially available aqueous slurry thereof, can be used in the composition of the present invention in the approximate proportions of 23 to 40 percent, by weight. The approximate lower limit (23 percent) is determined by the fact that below this limit, the color of the resultant ink 18, and of the resulting marked spot 26 on the paper ticket 24, is not sufficiently intense or vibrant. The approximate upper limit (40%) of the DAYGLO slurry, which may be used in the composition 18 of the invention, is determined by the fact that the marked spot 26 on the ticket 24 must not cover the underlying pre-printed number. In other words, the ink 18 must not become opaque.

Examples of colors with matching DAYGLO designations actually used in compositions made in accordance with the present invention, and specifically in accordance with the above-given specific formula, include the following:

| Colors | DAYGLO Designation |
|---|---|
| Blaze Orange | DAYGLO WT 15 |
| Aurora Pink | DAYGLO WT 11 |
| Rocket Red | DAYGLO WT 13 |
| Saturn Yellow | DAYGLO WT 17 |
| Signal Green | DAYGLO WT 18 |
| Horizon Blue | DAYGLO WA-W19 |

The amount of water used in the ink composition of the present invention is approximately in the range of 60 to 77 percent, by weight, in the sense that the foregoing proportions are given in such a manner that water makes up the remainder of the composition to give a total of 100 percent, by weight.

Figure 4:
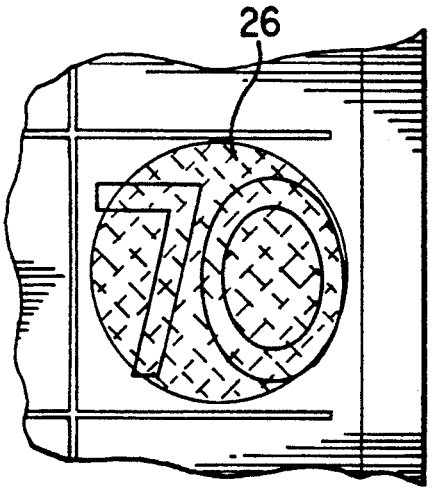
FIG. 4 is an enlarged view schematically showing the marked spot on the ticket.

Experience has shown that the ink compositions of the present invention, when used in the above-disclosed applicator device for marking relatively large spots on paper, provides superior results. The marking of a "throw-away" bingo ticket 24 is specifically shown as an example on FIGS. 3 and 4. The resulting marked spots 26 are significantly more brightly or vividly colored, than when ink compositions of the prior art are used in a similar applicator device.

It should be kept in mind that the foregoing advantageous results are attained by the unique combination of proper pigment selection coupled with the proper adjustment of the stability, penetrating power, and other above-described properties of the aqueous ink compositions of the invention. Inasmuch as several modifications of the invention may become readily apparent to those skilled in the art in light of the foregoing disclosure, the scope of the present invention should be interpreted solely from the following claims, as such claims are read in light of the disclosure.

What is claimed is:

1. A device for making pre-existing printed numbers on a bingo ticket with a vibrant colored, translucent mark, such as a spot, without obscuring the pre-existing numbers, the device comprising in combination:

a container having a mouth;

a porous applicator body mounted into the mouth of the container, said applicator body closing the container;

an aqueous, translucent, vibrant colored ink composition contained in the container, the ink composition and the applicator body being selected in such a manner that the ink composition is capable of penetrating the applicator, the ink composition comprising a vibrant, colored, bright pigment consisting essentially of:

approximately 23 to 40 percent, by weight, of an aqueous slurry of a dyed melamine copolymer resin;

an effective amount of a preservative agent adapted for substantially preventing bacterial and like growth in the ink composition;

an effective amount of a defoaming agent adapted for substantially preventing formation of bubbles when the ink composition is applied to paper through a sponge rubber applicator;

an effective amount of a stabilizer agent, selected from a group consisting of carboxymethylcellulose, clays, and aluminum silicate, approximately 60 to 77 percent, by weight, of water; and a cap removably mounted to the mouth of the container to seal the container for prolonged periods of time.

2. The device of claim 1 wherein the ink composition further comprises an effective amount of a substantially non-volatile antifreezing agent.

3. The device of claim 1 wherein the ink composition further comprises an effective amount of a thickening agent.

4. The device of claim 3 wherein the ink composition comprises approximately 23.5 percent, by weight, of the aqueous slurry of the dyed melamine copolymer resin.

5. The device of claim 2 wherein the ink composition comprises approximately 23.5 percent, by weight, of the aqueous slurry of the dyed melamine copolymer resin, approximately 0.3 percent, by weight, of the stabilizing agent consisting essentially of carboxymethylcellulose, and approximately 3.5 percent, by weight, of the antifreezing agent consisting essentially of ethylene glycol.

6. A device for making pre-existing printed symbols on paper with a vibrant colored, translucent ink composition, such as marking numbers selected by a player on a ticket for a game of chance, such as bingo tickets, the device comprising in combination:

a container having a mouth;

a porous sponge-type applicator body mounted into the mouth of the container, said applicator body comprising means for closing the container, sand for substantially preventing spillage of liquid from the container;

a free flowing aqueous, translucent, vibrant colored ink composition contained in the container, the ink composition and the applicator body being selected in such a manner that the ink composition is capable of penetrating the applicator, the ink composition comprising a vibrant, colored, bright pigment consisting essentially of a dyed melamine copolymer resin, an effective amount of defoaming agent, an effective amount of a stabilizing agent, and an effective amount of a preservative agent;

said ink composition comprises approximately 23 to 40 percent, by weight, of an aqueous slurry of the dyed melamine copolymer resin, and a cap removably mounted to the mouth of the container.

7. The device in claim 6 wherein the ink composition comprises approximately 23.5 percent of the dyed melamine copolymer resin formulation.

8. The device of claim 6 wherein the aqueous slurry of the dyed melamine copolymer resin comprises approximately 50 percent, by weight, of solid materials.

9. The device of claim 2 wherein the antifreezing agent consists essentially of ethylene glycol.

10. The device of claim 3 wherein the thickening agent is clay.

* * * * *

US005222823B1

REEXAMINATION CERTIFICATE (2861th)

United States Patent [19]

[11] B1 5,222,823

Conforti et al.

[45] Certificate Issued Apr. 30, 1996

[54] DEVICE FOR MARKING TICKETS FOR GAME OF CHANCE WITH TRANSLUCENT, VIBRANT COLORED INK

[76] Inventors: Patricia A. Conforti; Louis J. Conforti, both of 4217 Ironwood Ave., Seal Beach, Calif. 90740

Reexamination Request:
No. 90/003,285, Dec. 21, 1993

Reexamination Certificate for:

| | |
|---|---|
| Patent No.: | **5,222,823** |
| Issued: | **Jun. 29, 1993** |
| Appl. No.: | **851,344** |
| Filed: | **Apr. 14, 1986** |

[51] Int. Cl.[6] ..... B43K 5/00

[52] U.S. Cl. ..... 401/202; 106/20 R; 106/22 B; 106/23 B; 260/DIG. 38; 401/196; 401/198; 525/54.4

[58] Field of Search ..... 106/20 R, 22 B, 106/23 B; 260/DIG. 38; 401/196, 198, 202; 525/54.4

[56] References Cited

U.S. PATENT DOCUMENTS

| | | | |
|---|---|---|---|
| 173,064 | 2/1876 | Rose | 401/202 |
| 3,244,558 | 4/1966 | Chan | 117/38 |
| 3,436,163 | 4/1969 | Calabrese | 401/202 |
| 4,186,020 | 1/1980 | Wachtel | 106/22 |

OTHER PUBLICATIONS

Grau, Chemical Abstracts, v. 81, 1974, p. 99, #39079e.
Kato, Chemical Abstracts, v. 85, 1976, p.123, #126017j.
Akamatsu, Chemical Abstracts, v. 76, 1972, #114942h; German Patent No. 2,130,936.
Grau et al, Chemical Abstracts, v. 82, 1975, #157831n; Canadian Patent No. 954,291.
Day–Glo Color Corp. Technical Bulletin No. 1193A, 1981.
W. Meadows, Formulating with Fluorescent Pigments, Paint and Varnish Production–published Sep. 1974.
High Visibility Materials, A Bright Approach to Safety, *National Safety News*–published Jul. 1973.
Hand Andrews, Reprint from *Cleveland Press*–published Oct. 1974.
Fluorescent Inks Put Glow In Inter–Polymer Sales, *Flexography*–published Feb. 1973.
New York Firm Thrives on Fluroescent Litho Printing–published Jan. 1973.
Promotional Advertisement of Day–Glo Color Corp. including sample advertisement for Good & Plenty® Candy–published Jul. 1974.
Promotional Advertisement of Day–Glo Color Corp. including sample advertisement for Bold® Detergent Package–published Jul. 1974.
Promotion of Day–Glo Color Corp. including advertisement run in *Advertising Age* (6 times in 1978)–published in 1978.
Reprint from Point–of Purchase Advertising Institute–published 1974.
Study by Telcom Research on the Effect of Fluorescent Colors Used in Advertising Billboards–published in Nov. 1978.
Pantone® Color Formula Guide, Color Wheel, Pantone Corporation–published in 1982.

*Primary Examiner*—Mindy Fleisher

[57] ABSTRACT

A marking device for marking numbers on tickets of games of chance, such as "throw-away" bingo tickets, includes a container having a mouth and a porous applicator body mounted into the mouth. An aqueous, translucent, vibrant colored, substantially freely flowing liquid ink composition is contained in the container, and is applied to the game-of-chage tickets through the porous applicator body. The ink contains, in the aqueous medium, a dyed melamine copolymer resin which is known and available in the trade under the DAYGLO mark. The dyed melamine copolymer pigment provides the unusually bright color to the ink composition of the invention.

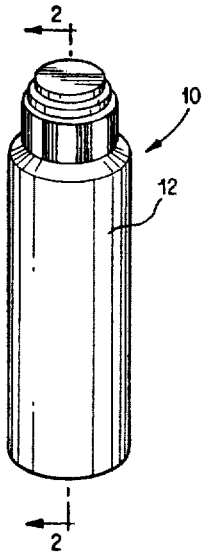

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1 and 6 are determined to be patentable as amended.

Claims 2–5 and 7–10, dependent on an amended claim, are determined to be patantable.

1. A device for [making] *marking* pre-existing printed numbers on a bingo ticket with a vibrant colored, translucent mark, such as a spot, without obscuring the pre-existing numbers, the device comprising in combination:

a container having a mouth;

a porous applicator body mounted into the mouth of the container, said applicator body closing the container;

an aqueous, translucent, vibrant colored ink composition contained in the container, the ink composition and the applicator body being selected in such a manner that the ink composition is capable of penetrating the applicator, the ink composition comprising a vibrant, colored, bright pigment consisting essentially of:

approximately 23 to 40 percent by weight, of an aqueous slurry of a dyed melamine copolymer resin;

an effective amount of preservative agent adapted from substantially preventing bacterial and like growth in the ink composition;

an effective amount of a defoaming agent adapted for substantially preventing formation of bubbles when the ink composition is applied to paper through a sponge rubber applicator;

an effective amount of a stabilizer agent, selected from a group consisting of carboxymethylcellulose, clays, and aluminum silicate, approximately 60 to 77 percent, by weight, of water; and a cap removably mounted to the mouth of the container to seal the container for prolonged periods of time.

6. A device for [making] *marking* pre-existing printed symbols on paper with a vibrant colored, translucent ink composition, such as marking numbers selected by a player on a ticket for a game of chance, such as bingo tickets, the device comprising in combination:

a contianer having a mouth;

a porous sponge-type applicator body mounted into the mouth of the container, said applicator body comprising means for closing the container, sand for substantially preventing spillage of liquid from the container;

a free flowing aqueous, translucent, vibrant colored ink composition contained in the container, the ink composition and the applicator body being selected in such a manner that the ink composition is capable of penetrating the applicator, the ink composition comprising a vibrant, colored, bright pigment consisting essentially of a dyed melamine copolymer resin, an effective amount of defoaming agent, an effective amount of a stabilizing agent, and an effective amount of a preservative agent;

said ink composition comprises approximately 23 to 40 percent, by weight, of an aqueous slurry of the dyed melamine copolymer resin, and a cap removably mounted to the mouth of the container.

* * * * *